US010766297B2

(12) United States Patent
Mazingue et al.

(10) Patent No.: US 10,766,297 B2
(45) Date of Patent: Sep. 8, 2020

(54) HAND-HELD DEVICE, IN PARTICULAR A WRITING INSTRUMENT, HAVING TWO RETRACTABLE HEADS

(71) Applicant: SOCIETE BIC, Clichy (FR)

(72) Inventors: Laurent Mazingue, Paris (FR); Etienne Michenaud, Paris (FR); Arnaud Bez, Garches (FR)

(73) Assignee: SOCIETE BIC, Clichy (FR)

( * ) Notice: Subject to any disclaimer, the term of this patent is extended or adjusted under 35 U.S.C. 154(b) by 0 days.

(21) Appl. No.: 16/388,963

(22) Filed: Apr. 19, 2019

(65) Prior Publication Data

US 2019/0322121 A1 Oct. 24, 2019

(30) Foreign Application Priority Data

Apr. 19, 2018 (FR) ..... 18 53471

(51) Int. Cl.

| | |
|---|---|
| ***B43K 24/00*** | (2006.01) |
| ***B43K 24/03*** | (2006.01) |
| ***B43K 24/10*** | (2006.01) |
| ***B43K 24/12*** | (2006.01) |
| ***B43K 29/02*** | (2006.01) |

(52) U.S. Cl.

CPC ..... *B43K 24/03* (2013.01); *B43K 24/00* (2013.01); *B43K 24/10* (2013.01); *B43K 24/12* (2013.01); *B43K 29/02* (2013.01)

(58) Field of Classification Search

CPC ..... B43K 24/00; B43K 24/02; B43K 24/03; B43K 24/04; B43K 24/06; B43K 24/08; B43K 24/10; B43K 24/12; B43K 24/14; B43K 24/16; B43K 24/166; B43K 27/00; B43K 29/02

USPC ..... 401/29–33, 115, 117

See application file for complete search history.

(56) References Cited

U.S. PATENT DOCUMENTS 2,757,639 A * 8/1956 Wichmann ..... B43K 24/03 401/115

7,296,942 B2 * 11/2007 Mayne ..... B43K 24/04 401/115

* cited by examiner

*Primary Examiner* — David J Walczak

(74) *Attorney, Agent, or Firm* — Ohlandt, Greeley, Ruggiero & Perle, L.L.P.

(57) ABSTRACT

A hand-held device, in particular a writing instrument, comprising a body, a single carriage carrying a first head and a second head, or a first carriage and a second carriage carrying respectively the first head and the second head, and a blocking device including a cavity and a ball, the ball) blocking the single carriage or the first carriage when the first end is below the second end, such that the first head is blocked and projecting while the second head is retracted, and the ball blocking the single carriage or the second carriage when the first end is above the second end, such that the second head is blocked and projecting while the second first head is retracted.

16 Claims, 5 Drawing Sheets

HAND-HELD DEVICE, IN PARTICULAR A WRITING INSTRUMENT, HAVING TWO RETRACTABLE HEADS

CROSS REFERENCE TO RELATED APPLICATION

This application claims priority to French Application FR1853471, filed Apr. 19, 2018, the entire content of which is incorporated herein by reference.

TECHNICAL FIELD

The present disclosure relates to a hand-held device having two opposite retractable heads, in which one head is retracted while the other head is in a utilization position, and vice versa. In particular such a hand-held device may be a writing instrument, but not necessarily.

BACKGROUND

Writing instruments with two opposite retractable heads are known in which one head is retracted while the other head is in a utilization position, and vice versa. Nevertheless, those retraction mechanisms do not always give full satisfaction, in particular from the point of view of ease of use. There therefore exists a need in this sense.

SUMMARY

An embodiment provides a hand-held device, in particular a writing instrument, comprising a body extending along an axial direction and presenting a first axial end and a second axial end opposite from the first axial end along the axial direction, a single carriage housed in the body and movable in translation along the axial direction relative to the body, the single carriage carrying a first head and a second head opposite from the first head along the axial direction, or a first carriage and a second carriage housed in the body and being movable in translation along the axial direction relative to the body, the first carriage and the second carriage carrying respectively a first head and a second head opposite from the first head along the axial direction, and a single blocking device comprising a single cavity and at least one ball or the equivalent, one ball or the equivalent of the at least one ball or the equivalent blocking the single carriage or the first carriage relative to the body when, relative to the gravity direction, the first axial end is below the second axial end, such that the first head is blocked relative to the body so as to project axially from the first axial end, while the second head is retracted into the body, and one ball or the equivalent of the at least one ball or the equivalent blocking the single carriage or the second carriage when, in the gravity direction, the first axial end is above the second axial end, such that the second head is blocked relative to the body so as to project axially from the second axial end, while the first head is retracted into the body.

It can be understood that the hand-held device comprises either a single carriage, or else a first carriage and a second carriage. The term "single carriage" is used to mean a single entity capable of travelling as a unit along the axial direction, this entity potentially comprising a single part or a plurality of parts that are coupled to move together axially in translation. The term "a first carriage and a second carriage" designates two carriages that are independent of each other, in particular in the axial direction. Consequently, and unless specified to the contrary, the term "the carriage" is used to cover either "the single carriage" or "the first carriage and the second carriage".

The term "gravity direction" naturally designates the direction of Newtonian gravitational acceleration created by the Earth, or more generally by the (celestial) body on which the hand-held device is used.

The term "ball or the equivalent" is used to mean any solid element of any shape that is movable in the cavity and suitable for moving in the cavity under the effect of gravity relative to walls defining the cavity. Consequently, unless mentioned to the contrary, the term "ball" is used to cover "ball or the equivalent". For example, the ball may be made of metal, but not necessarily.

The hand-held device may include a single ball or a plurality of balls, e.g. two or more balls. Thus, the term "a ball or the equivalent of the at least one ball or the equivalent" covers "the ball or the equivalent" if the blocking device has a single ball or the equivalent or else "one ball or the equivalent from the plurality of balls or the equivalent" if the blocking device has a plurality of balls or the equivalent. Consequently, and unless specified to the contrary, the term "the ball" may cover "at least one ball or the equivalent".

The single cavity is formed by a single hollow volume, within which the ball can move under the effect of gravity. In other words, the cavity houses the ball. The cavity may be of any shape, which may be simple or complex. For example, the cavity may comprise one or more chambers of dimensions that are fixed or variable, these chambers being connected by passages within which the ball can move in order to pass from one chamber to another. The body and the carriage may form all or some of the walls of the cavity. Thus, the shape and/or the dimensions (or the volume) of the cavity are suitable for changing as a function of the position of the carriage relative to the body.

For example, the first head and/or the second head may be formed by any hand-held device tool endpiece, e.g. an endpiece comprising a key, a screwdriver, a blade, a punch, a writing tip (felt tip, ball or other point, graphite lead, chalk, or any means suitable for writing on a substrate), a brush, an eraser, a friction body, an active or passive endpiece configured to co-operate with a touch screen, e.g. a capacitive, resistive, inductive, infrared, optical, electrostatic, etc. screen, a cosmetic applicator (brush, pencil, mascara brush, roll-on applicator, lipstick, or any cosmetics applicator means), etc.

In the variant having a single carriage, as a result of the ball moving within the cavity, when the first axial end is below the second axial end relative to the gravity direction, the single ball or one ball from the plurality of balls co-operates with the single carriage in order to block it relative to the body in the axial direction so that the first head carried by the single carriage extends outside (i.e. at least in part outside) the body from the first axial end. Under such circumstances, the second head is retracted (i.e. fully retracted) in the body. In this variant, since the second head is mounted on the single carriage, it is also blocked in this position.

Conversely, still as a result of the ball moving within the cavity, when the first axial end is above the second axial end relative to the gravity direction, the single ball or one ball from among the plurality of balls co-operates with the single carriage to block it relative to the body in the axial direction, such that the second head carried by the single carriage extends outside (i.e. at least in part outside) the body from the second axial end. Under such circumstances, the first head is retracted (i.e. fully retracted) in the body. In this variant, since the first head is mounted on the single carriage, it is also blocked in this position.

In the variant having a first carriage and a second carriage, as a result of the ball moving within the cavity, when the first axial end is below the second axial end relative to the gravity direction, the single ball or one ball among the plurality of balls co-operates with the first carriage to block it relative to the body in the axial direction so that the first head carried by the first carriage extends outside (i.e. at least in part outside) the body from the first axial end. Under such circumstances, the second head is retracted (i.e. fully retracted) in the body. The second carriage carrying the second head may be blocked or not blocked relative to the body.

Conversely, still as a result of the ball moving within the cavity, when the first axial end is above the second axial end relative to the gravity direction, the single ball or one ball from the plurality of balls co-operates with the second carriage to block it relative to the body in the axial direction such that the second head carried by the second carriage extends outside (i.e. at least in part outside) the body from the second axial end. Under such circumstances, the first head is retracted (i.e. fully retracted) in the body. The first carriage carrying the first head may be blocked or not blocked relative to the body.

Thus, both in the first variant and in the second variant, it can be understood that the hand-held device takes on a first configuration in which the first head projects from the body from its first end while the second head is retracted in the body, and a second configuration in which the second head projects from the body from the second end while the first head is retracted in the body. In the first configuration, the first head is in a utilization position while the second head is in a retracted position, and conversely, in the second configuration, the second head is in a utilization position while the first head is in a retracted position.

In order to pass from the first configuration to the second configuration, and vice versa, the first end, which is below the second end in the first configuration, is caused to pass above the second end, and vice versa. During this changeover, as a result of gravity, the ball co-operating with the single carriage or the first carriage in the first configuration becomes disengaged and moves in the cavity so that it no longer co-operates with the single carriage or the first carriage, and a ball, the same ball or another ball, comes to co-operate with the single carriage or the second carriage in the second configuration. In other words, the blocking device is a gravity blocking device that operates automatically and solely as a result of the effects of gravity.

If there is only one ball, it is this single ball that co-operates with the single carriage or with the first and second carriages. If there is more than one ball, a first ball co-operates with the single carriage or the first carriage in the first configuration, and a second ball, distinct from the first ball, co-operates with the single carriage or with the second carriage in the second configuration, for example.

Thus, by means of the blocking device having a single cavity and the ball, the head that the user intends to use (i.e. the head pointing downwards relative to the gravity direction) automatically takes up a utilization position and is blocked therein, while the other head automatically takes up a retracted position. This makes the hand-held device particularly easy to use.

In some embodiments, the single cavity comprises a first chamber and a second chamber distinct from the first chamber, the first chamber being formed between the body and the single carriage or between the body and the first carriage, the second chamber being formed between the body and the single carriage or between the body and the second carriage, one ball or the equivalent of the at least one ball or the equivalent being housed in the first chamber when, in the gravity direction, the first axial end is below the second axial end, and one ball or the equivalent of the at least one ball or the equivalent being housed in the second chamber when, in the gravity direction, the first axial end is above the second axial end.

The single cavity has two chambers, namely the first chamber and the second chamber, the first chamber being configured to receive the ball that co-operates with the single carriage or with the first carriage in the first configuration, while the second chamber is configured to receive the ball that co-operates with the single carriage or with the second carriage in the second configuration.

This enables the single cavity to be properly configured relative to the ball as a function of the configuration of the hand-held device. The accuracy of the blocking device is improved, thereby contributing to ease of use.

In some embodiments, the dimensions (or indeed the volume) of the first chamber and/or the dimensions (or indeed the volume) of the second chamber vary as a function of the position of the single carriage or the positions of the first and second carriages relative to the body.

For example, the dimensions of the first and/or the second chamber vary so that the space in the first and/or the second chamber that is configured to receive a ball varies between zero space and a non-zero predetermined maximum space.

This makes it possible to ensure that the blocking device is compact, thereby enabling a hand-held device to be obtained of dimensions that are suitable for being gripped and manipulated easily.

In some embodiments, each chamber includes an inlet and an end, all or some of the walls of the first chamber and/or all or some of the walls of the second chamber converging from the inlet towards the end.

It can be understood that the inlet of a chamber is the location through which the ball passes in order to enter and/or leave the chamber, while the ball cannot go beyond the end of the chamber when it is in the chamber. The end may be open or closed. For example, the ball may project in part from the chamber through its end, but cannot escape completely from the chamber via its end. By way of example, the walls of the chamber extending between the inlet and the end of the chamber, referred to as "side" walls, slope relative to one another (i.e. they are not parallel) such that the space between the side walls decreases going from the inlet towards the end. For example, the maximum space between the walls of the chamber at the end of the chamber is less than the diameter of the ball that is configured to be received in said chamber.

Converging walls make it possible to ensure that the ball that is configured to be received in the chamber co-operates with the walls of the chamber so as to block the carriage axially relative to the body without slack. In other words, the converging walls form a slack take-up system. Thus, when the head carried by the carriage is in the utilization position, there is very little or no axial slack, thereby providing a degree of comfort and a degree of ease in use.

In some embodiments, the single cavity includes a passage for the at least one ball or the equivalent, the passage extending between the first chamber and the second chamber, the passage being arranged between the body and the single carriage or between the body and the first and second carriages.

This passage enables the ball to move between the first chamber and the second chamber. It can thus be understood that the passage is located axially between the first chamber and the second chamber. For example, the single cavity comprises solely the first chamber, the second chamber, and the passage connecting the first and second chambers together. For example, the passage is defined solely by the body and by the carriage.

This serves to provide a blocking device that is compact, thereby providing the hand-held device with dimensions that are appropriate for being gripped and handled easily.

In some embodiments, the hand-held device comprises at least one striker configured to strike one ball of the at least one ball or the equivalent when, along the gravity direction, the first axial end passes from a position above the second axial end to a position below the second axial end, and/or along the gravity direction when the first axial end passes from a position below the second axial end to a position above the second axial end.

In other words, the striker is configured to strike the ball that is blocking the carriage relative to the body. For example, the striker may be a flyweight that is movable axially and that is distinct from the at least one ball, or it may be one of the balls of said at least one ball. It can thus be understood that the striker is movable under the effect of gravity. For example, the striker is configured to strike the ball in the axial direction.

On passing from the first configuration to the second configuration, or vice versa, the striker facilitates disengaging the ball that is blocking the carriage relative to the body. This ensures that the carriage is indeed unblocked and free to move axially within the body. Such a striker serves to avoid any untimely blocking of the carriage within the body and ensures that use of the hand-held device is even easier.

In some embodiments, the hand-held device includes two strikers and, in the axial direction, the at least one ball or the equivalent is arranged between the two strikers.

It can thus be understood that a first striker serves to disengage the single ball when it is desired to pass from the first configuration to the second configuration, while the second striker serves to disengage the single ball when it is desired to pass from the second configuration to the first configuration. Naturally, this structure having a single ball and two strikers may be used in hand-held devices having a single carriage or in hand-held devices having two carriages. Such a structure is particularly reliable.

In some embodiments, the two strikers are coupled together (i.e. they are mechanically coupled together) in the axial direction.

Coupling together the two strikers increases the weight of the moving assembly that strikes the ball blocking the carriage in position. The percussive effect of the unblocking is thus improved so that handling of the hand-held device is further facilitated.

BRIEF DESCRIPTION OF THE DRAWINGS

The subject matter of the present disclosure and its advantages can be better understood in the light of the following detailed description of various embodiments given as non-limiting examples. The description refers to the sheets of the accompanying figures, in which.

DETAILED DESCRIPTION

Figure 1:
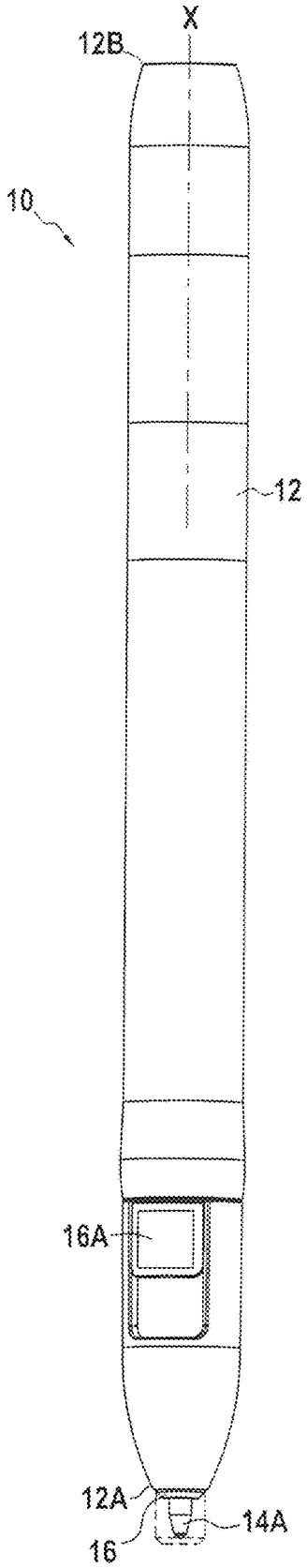
FIG. 1 shows a first embodiment of the hand-held device.

FIG. 1 shows a hand-held device 10, in this example a writing instrument, and more particularly a pen having a retractable ballpoint, comprising a body 12 that extends in an axial direction X. The body 12 has a first axial end 12A and a second axial end 12B opposite from the first axial end 12A along the axial direction X. A first head 14A is configured to project, in retractable manner, from the first axial end 12A, while a second head 14B is configured to project, in retractable manner, from the second axial end 12B. In this example, the first head 14A is a ballpoint having thermochromic ink, while the second head 14B is a friction body. It should be recalled that a friction body is a body configured to be rubbed against a surface, e.g. in order to generate heat, and thereby changing the color of an ink that is thermochromic, i.e. an ink that changes color as a function of the heat to which it is subjected. Naturally, heads of any other kinds could be envisaged for the first head and for the second head. In FIG. 1, the first head 14A projects from the body 12 from the first axial end 12A, while the second head 14B is retracted into the body 12. In other words, the first head 14A is in a utilization position, while the second head 14B is in a retracted position. It should be observed that the body 12 is fitted with retractable protection 16 configured to protect the first head 14A and to avoid untimely dirtying when the hand-held device 10 is not in use. This retractable protection 16 is in the form of a sheath that can be moved axially between a protection position (in dashed lines in FIG. 1) in which it protects the first head 14A even when it is in its utilization position, and a disengaged position (in continuous lines in FIG. 1) in which the first head 14A can be used normally while it is in the utilization position. This protection 16 includes means known to the person skilled in the art for moving it between its two positions, in particular a button 16A, and for holding it in each of the protection and disengaged positions.

The hand-held device 10 is described in greater detail below with reference to FIG. 2. The hand-held device 10 in this example has a single carriage 14 housed in the body 12 and axially movable within the body 12. The carriage 14 carries the first head 14A and the second head 14B, the first head 14A being arranged beside the first axial end 12A, while the second head 14B is arranged beside the second axial end 12B. In this example, each head is mounted on the carriage 14 by screw-fastening, however any other assembly means known to the person skilled in the art could be envisaged.

In this example, the single carriage 14 comprises two distinct identical parts 14-1 and 14-2 that are assembled together, so as to be mechanically coupled together. In particular, these two parts 14-1 and 14-2 are coupled to move in translation along the axial direction X. Each part 14-1 and 14-2 presents a base 15A extending in the axial direction X and having one of the heads 14A or 14B fastened thereto, and a receptacle 15B configured to receive the ball 18B of the blocking device 18 as described below. In this example, the concave side of the receptacle 15B has an upside-down V shape, with the ball 18B being capable of going to one side or the other of the V-shape. Naturally, in a variant, the concave side of the receptacle could have any other shape, e.g. only one branch of the V-shape, or a conical or a frustoconical shape.

Figure 4:
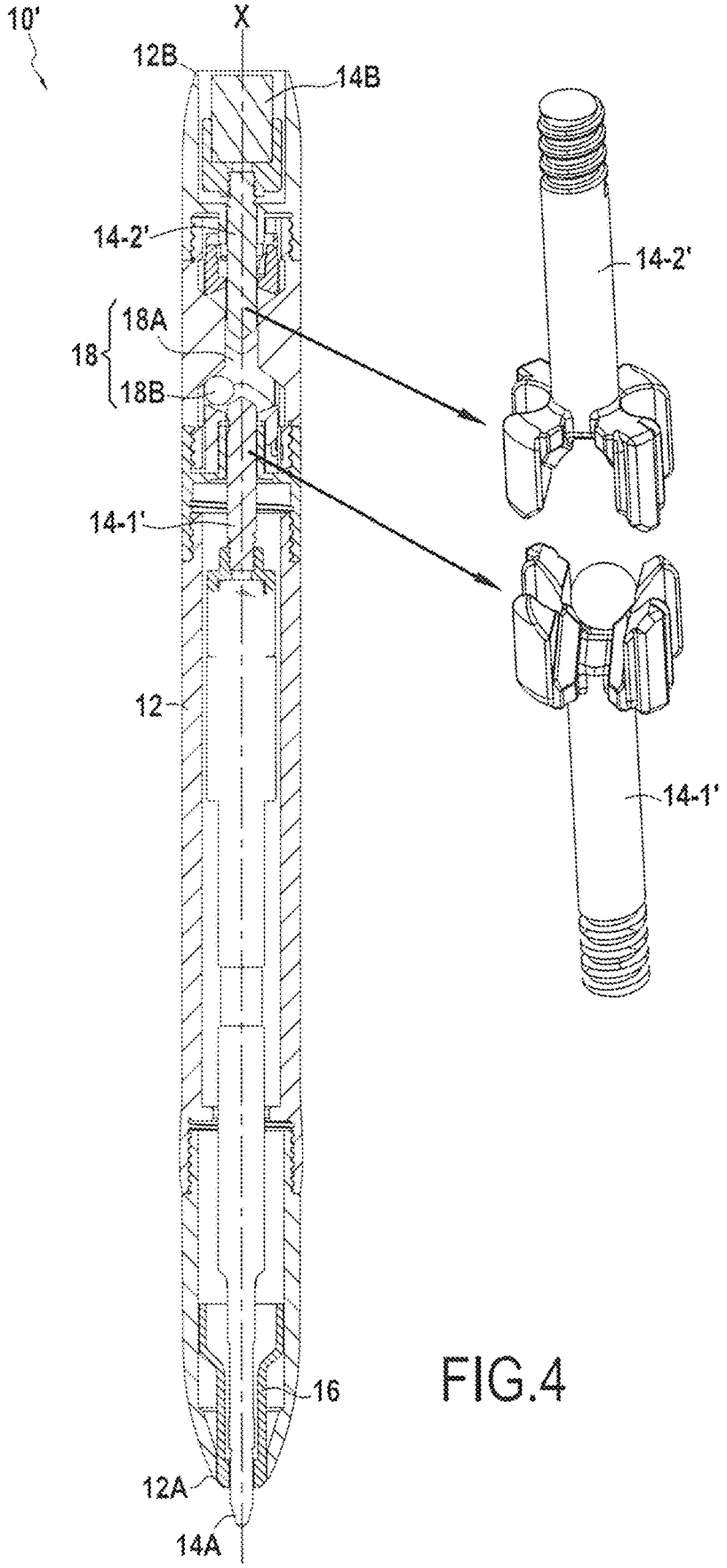
FIG. 4 shows a second embodiment of the hand-held device.

In this example, the two parts 14-1 and 14-2 are assembled together by clip fastening via axial tabs extending from the receptacles, so that the receptacle of each part faces the receptacle of the other part along the axial direction X. Naturally, these two parts 14-1 and 14-2 could be assembled together by any other means known to the person skilled in the art. In a variant that is shown in FIG. 4, the parts 14-1' and 14-2' do not have assembly means and they are independent of each other. Thus, the hand-held device in the variant of FIG. 4 presents a first carriage 14-1' and a second carriage 14-2' that is distinct from the first carriage 14-1'.

The hand-held device 10 has a single blocking device 18 presenting a single cavity 18A and in this example a single metal ball 18B received in the single cavity 18A. In a variant, there could be two or more balls moving in the single cavity 18A.

The cavity 18A is arranged between the carriage 14 and the body 12 and it presents a first chamber 18A1, a second chamber 18A2 distinct from the first chamber 18A1, and a passage 18A3 connecting the first and second chambers 18A1 and 18A2 together.

The portion of the body 12 that receives the carriage 14 is cylindrical, and it presents two diametrically opposite internal radial projections 12C extending towards the inside of the body 12. Each projection 12C presents a first axial end wall 12C1, a second axial end wall 12C2 that is opposite in the axial direction from the first axial end wall, and an axial wall 12C3 that extends between the first and second axial end walls 12C1 and 12C2. The radial space between the carriage 14 and the radial projections 12C along the axial walls 12C3 forms the passage 18A3 in which the ball 18B moves in order to go from one chamber to the other. The space between the first axial end walls 12C1 and the carriage 14 forms the first chamber 18A1, while the space between the second axial end wall 12C2 and the carriage 14 forms the second chamber 18A2. In other words, the first chamber 18A1 is defined by the first axial end walls 12C1 and the facing walls of the carriage 14, while the second chamber 18A2 is defined by the second axial end walls 12C2 and the facing walls of the carriage 14. More particularly, in this example, the first chamber 18A1 is defined by the first axial end walls 12C1 and the walls forming the V-shape of the receptacle 15A of the part 14-1 of the carriage 14. In similar manner, in this example, the second chamber 18A2 is defined by the second axial end walls 12C2 and the walls forming the V-shape of the receptacle 15A of the part 14-2 of the carriage 14.

The walls of the V-shape of the receptacle 15B are not parallel to the axial end walls 12C1 and 12C2. In other words, the walls of the first and second chambers converge. More precisely, each chamber 18A1 and 18A2 presents an inlet E and an end F, the walls converging from the inlet E towards the end F. In this example, when considered in section along the axial direction X, the first axial end walls 12C1 and the walls forming the V-shape of the receptacle facing the first axial end walls 12C1 are inclined relative to one another at an angle $\alpha$ (see enlargement in FIG. 2). In this example, $\alpha=3°$ (three degrees of angle). Likewise, in this example, when considered in section along the axial direction X, the second axial end walls 12C2 and the walls forming the V-shape of the receptacle facing the second axial end walls 12C2 are inclined at an angle $\alpha$ relative to each other. Naturally, the angles $\alpha$ of the first chamber 18A1 and of the second chamber 18A2 may be identical or different.

Since the carriage 14 is movable along the axial direction X relative to the body 12, the dimensions of the first chamber 18A1 and of the second chamber 18A2 vary as a function of the position of the carriage 14 relative to the body 12. In particular, in FIG. 2, the first chamber 18A1 has its maximum dimensions (and its maximum volume), while the second chamber 18A2 is reduced to its minimum and presents zero volume. Conversely, in FIG. 3E, the second chamber 18A2 presents its maximum dimensions (and its maximum volume), while the first chamber 18A1 is reduced to its minimum and presents zero volume. The diameter of the ball 18B is greater than the minimum width of the converging portion formed by each chamber when the chamber presents its maximum dimensions, such that the ball 18B cannot escape from the chamber through its end. Furthermore, in this example, depending on the position of the carriage 14 relative to the body 12, the passage 18A3 is shut beside one or the other of the axial ends of the body by the carriage 14. Naturally, depending on the variant, the passage could remain open regardless of the position of the carriage 14 relative to the body 12.

The hand-held device 10 in this example includes two strikers 20A and 20B. Considered in the axial direction, the ball 18B is arranged between the two strikers 20A and 20B. More particularly in this example, the carriage 14 is arranged axially between the two strikers 20A and 20B. In this example, the two strikers 20A and 20B are coupled together in translation in the axial direction X by means of a rod (not shown) connecting them together. In this example, the strikers 20A and 20B strike the ball 18B via the open end of each chamber 18A1, 18A2.

The operation of the hand-held device 10 is described below with reference to FIGS. 3A to 3E.

Figure 2:
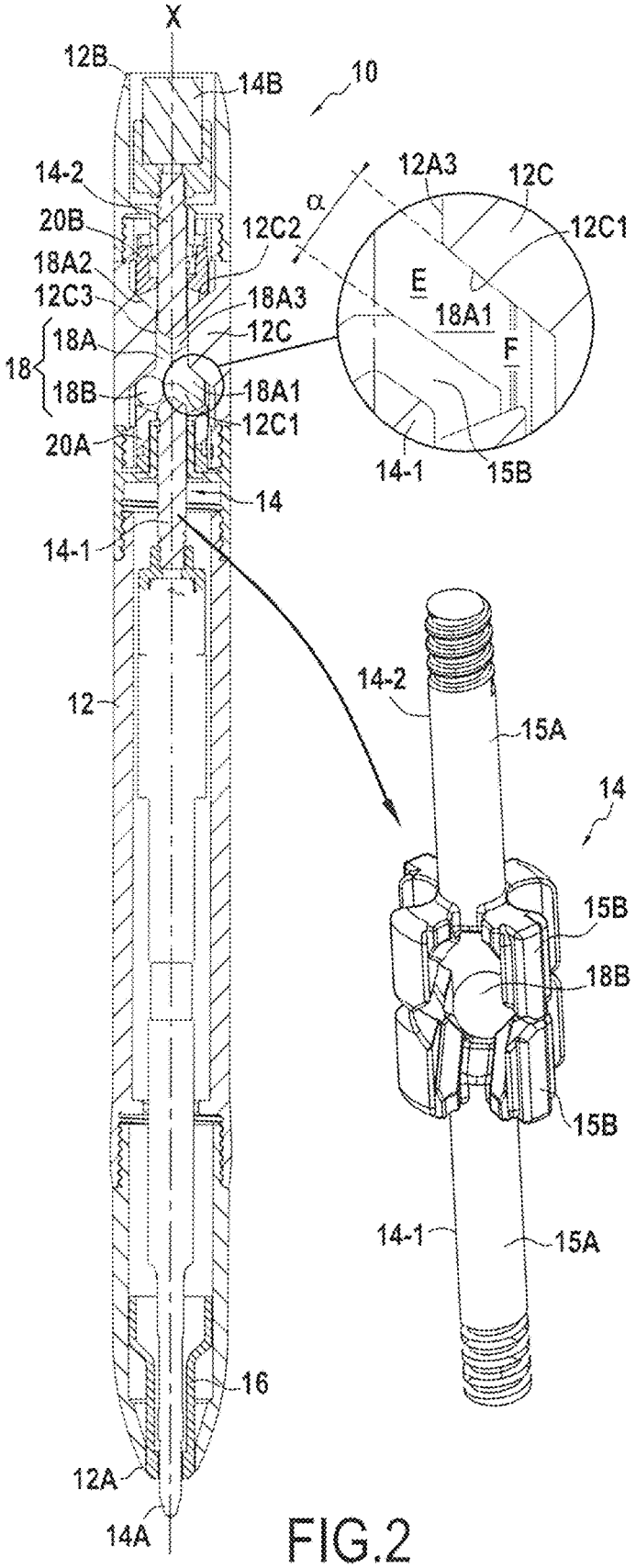
FIG. 2 is an axial section view of the FIG. 1 hand-held device.
Figure 3A:
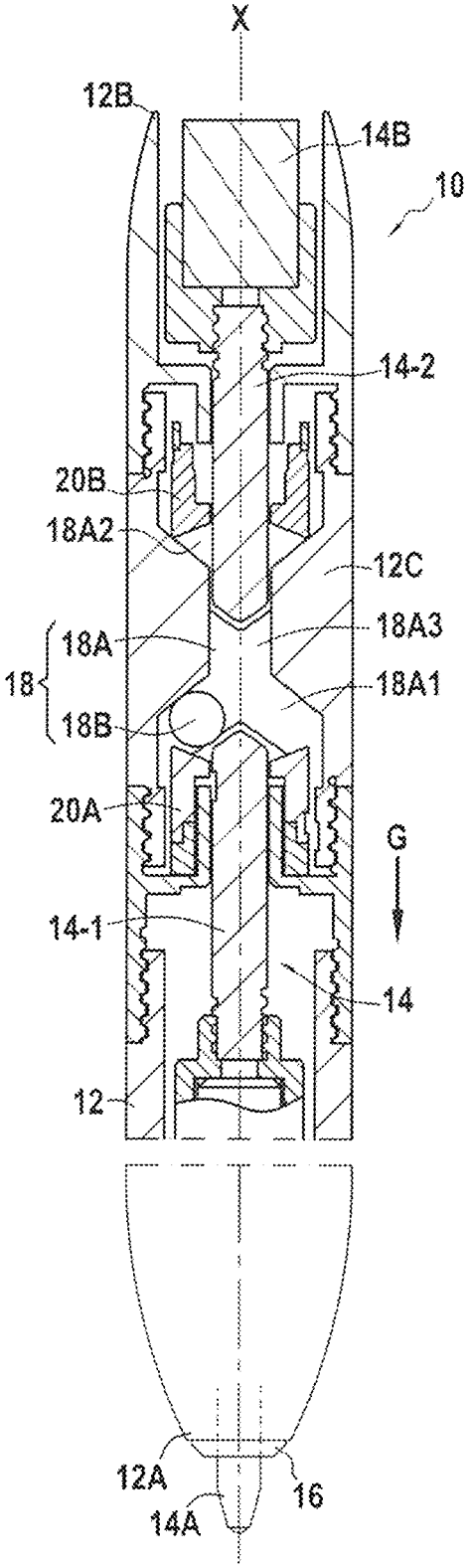
FIGS. 3A to 3E show various steps for passing from the first configuration to the second configuration.

FIG. 3A shows the hand-held device in the configuration of FIGS. 1 and 2, i.e. the first configuration in which the first head 14A is in its utilization position while the second head 14B is in its retracted position. In this configuration, considered along the gravity direction G, the first axial end 12A is below the second axial end 12B. The ball 18B is in the first chamber 18A1 and it blocks the carriage 14 axially relative to the body 12. Specifically, the ball 18B is interposed between the carriage 14 and a radial projection 12C of the body 12, without any slack because of the converging shape of the walls of the first chamber 18A1. Thus, when the user seeks to make use of the first head and presses thereon while writing on a substrate, the head is blocked in position by means of the ball 18B, thereby blocking movement of the carriage 14 and thus of the first head 14A along the axial direction X from the first axial end 12A towards the second axial end 12B. Naturally, movement of the carriage 14, and thus of the first head 14A, along the axial direction X from the second axial end 12B towards the first axial end 12A is blocked by a shoulder of the body 12 that is not shown. With the carriage 14 blocked relative to the body 12 and carrying the first and second heads, the heads 14A and 14B are blocked respectively in the utilization position and in the retracted position.

Figure 3B:
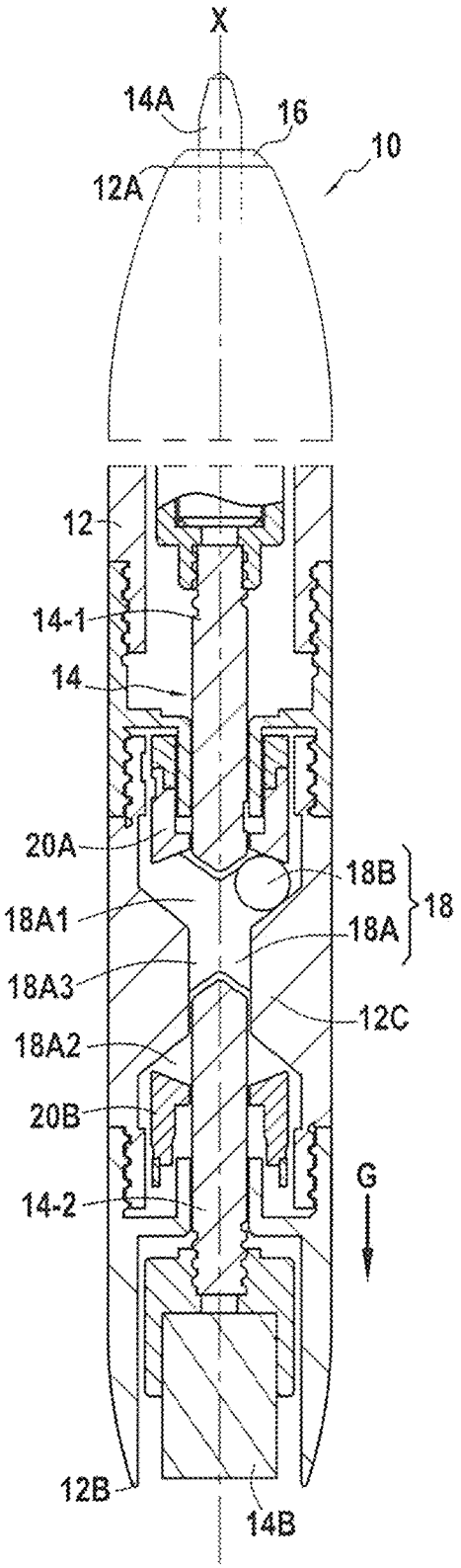

In order to go to the second configuration in which the first head 14A is in the retracted position and the second head 14B is in the utilization position, it suffices to cause the first axial end 12A to pass above the second axial end 12B relative to the gravity direction G, as shown in FIG. 3B. In this position, as a result of gravity, the striker 20A strikes the ball 18B, thereby having the effect of assisting it to become disengaged from the walls of the first chamber 18A1. In a variant without a striker the ball 18B disengages on its own from the walls of the first chamber 18A1 under the effect of gravity with this being made possible by its relatively large weight, the ball 18B in this example being made of metal.

Figure 3C:
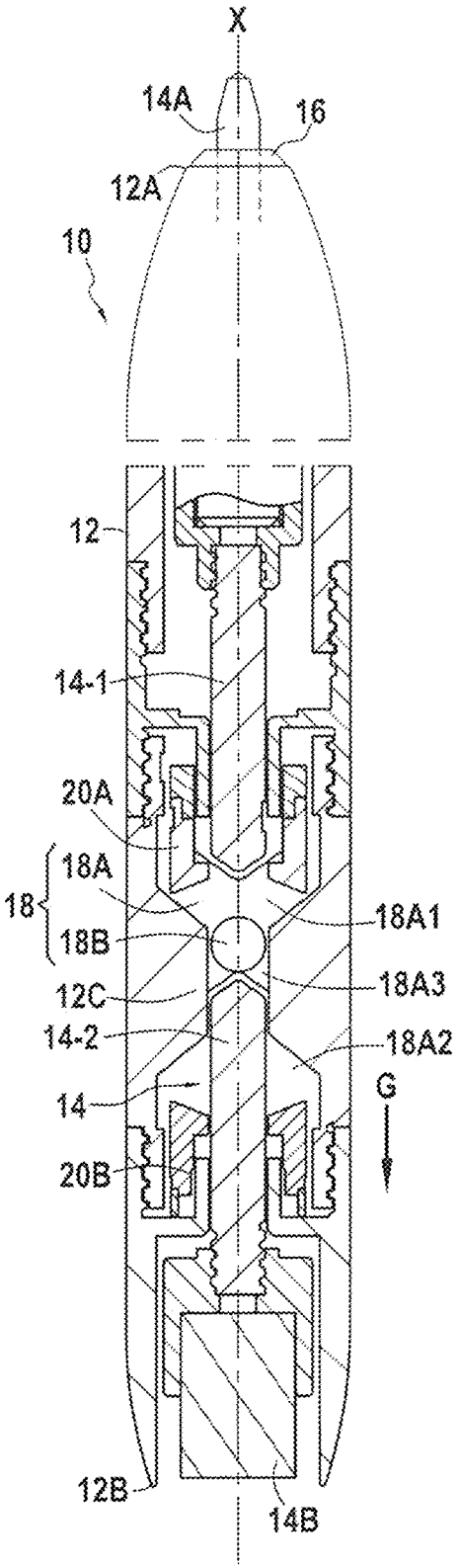

When the ball 18B disengages, it moves under the effect of gravity, and it leaves the first chamber 18A1 to go into the passage 18A3, as shown in FIG. 3C. As a result, the carriage 14 becomes free to move along the axial direction X relative to the body 12, since it is no longer blocked by the ball 18B.

Figure 3D:
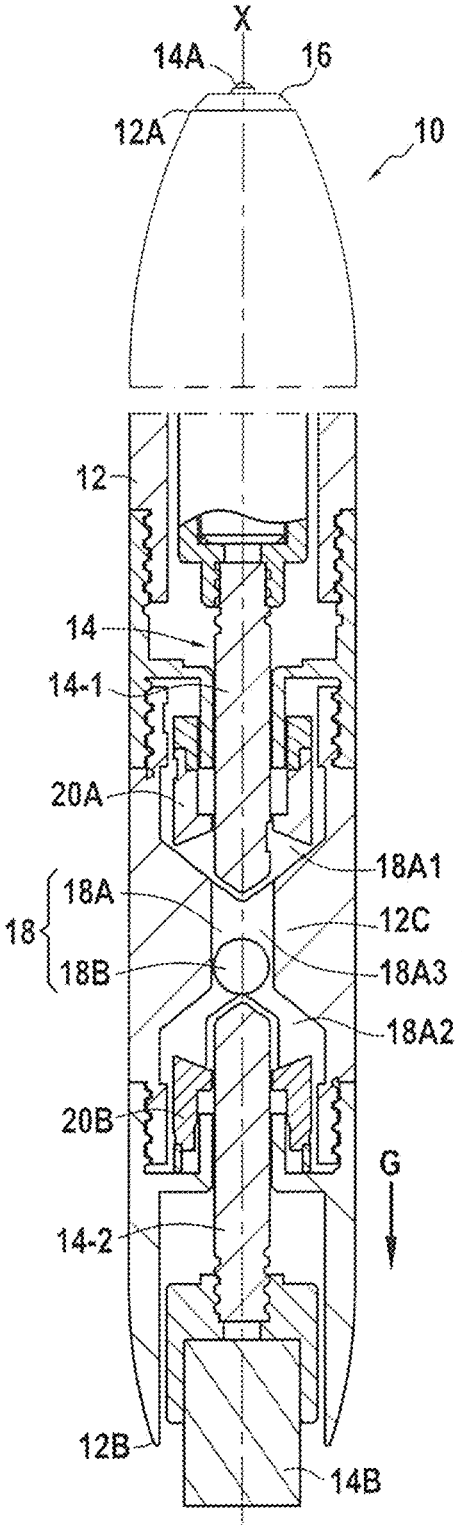

Under the effect of gravity, the carriage 14 moves towards the second axial end 12B, as shown in FIG. 3D. It should be observed that during this movement, the dimensions of the first chamber 18A1 become smaller until the volume of the first chamber 18A1 is zero, while the volume of the second chamber 18A2 becomes non-zero and increases progressively.

Figure 3E:
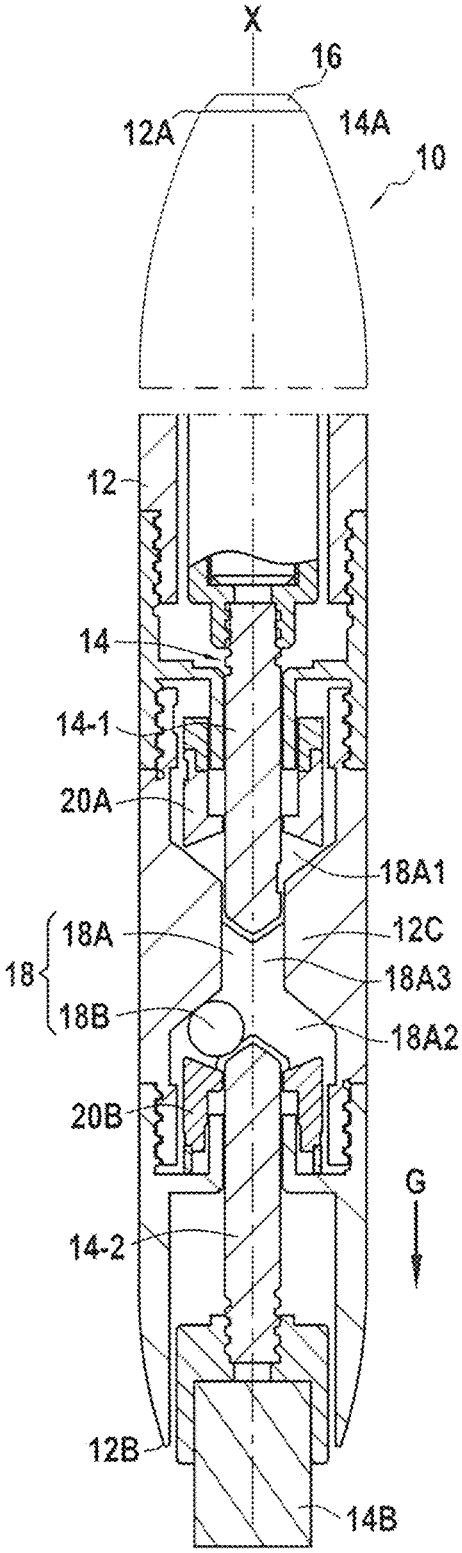

In FIG. 3E, the volume of the second chamber 18A2 is at a maximum, and the ball 18B, still under the effect of gravity, has left the passage 18A3 and penetrated into the second chamber 18A2 in order to become wedged, without slack, between the converging walls of the second chamber 18A2.

During this movement, the carriage 14 takes with it the first head 14A from its utilization position to its retracted position and the second head 14B from its retracted position to its utilization position. The hand-held device 10 is thus in the second configuration. With the ball 18B blocking the carriage 14 relative to the body 12, the user can easily make use of the second head 14B, which remains in position, even when the user presses against a substrate. In other words, when the user seeks to make use of the second head 14B, and presses down against a substrate, the head is blocked in position by the ball 18B, which blocks movement of the carriage 14 and thus of the second head 14B along the axial direction X from the second axial end 12B towards the first axial end 12A. Naturally, movement of the carriage 14, and thus of the second head 14B, along the axial direction X from the first axial end 12A towards the second axial end 12B is blocked by a shoulder of the body 12 (not shown). With the carriage 14 blocked relative to the body 12 and carrying the first and second heads, the heads 14A and 14B are blocked respectively in the retracted position and in the utilization position.

In order to return to the first configuration, it suffices to make the opposite movement, i.e. to place the first axial end 12A below the second axial end 12B in the gravity direction G. Under the effect of gravity, the striker 20B then strikes the ball 18B, which disengages from the second chamber 18A2, and releases the carriage 14, which moves axially, taking with it the heads 14A and 14B until the ball becomes inserted in the first chamber 18A1 and blocks the carriage 14 relative to the body 12. This is a return to the first configuration shown in FIG. 3A.

FIG. 4 shows a second embodiment of the hand-held device 10', that is identical to the hand-held device 10 of the first embodiment, with the exception of the carriage. Thus, the other elements are not described again and their reference signs remain unchanged.

In this second embodiment, there is not a single carriage, but rather a first carriage 14-1' and a second carriage 14-2' carrying respectively the first head 14A and the second head 14B. Thus, in the first configuration, when the first head 14A is in the utilization position and the second head 14B is in the retracted position, the first head 14A is blocked in this position by the ball 18B, while the second head 14B is not blocked in this position, since the second carriage 14-2' is not blocked by the ball 18B (whereas the first carriage 14-1' is blocked by the ball 18B). Nevertheless, as a result of gravity, the second head 14B remains in the retracted position. Conversely, in the second configuration in which the first head 14A is in the retracted position and the second head 14B is in the utilization position, the second head 14B is blocked in this position by the ball 18B, while the first head 14A is not blocked in this position, since the first carriage 14-1' is not blocked by the ball (even though the second carriage 14-2' is blocked by the ball 18B). Nevertheless, as a result of gravity, the second head 14B remains in the retracted position.

It should be observed that deciding whether to design the hand-held device with one carriage or with two carriages may depend on requirements concerning size and/or the strength of the blocking of the carriage by the ball, but not necessarily. Specifically, the two-carriage variant enables larger areas to be provided for interaction with the ball than in the one-carriage variant (the amplitude of the axial movement needed is smaller with two carriages than one with carriage), which means that the blocking provided by the ball can be more robust.

Although the present invention is described with reference to specific embodiments, it is clear that modifications and changes may be carried out thereon without going beyond the general ambit of the invention as defined by the claims. In particular, individual characteristics of the various embodiments shown and/or mentioned may be combined in additional embodiments. Consequently, the description and the drawings should be considered in a sense that is illustrative rather than restrictive.

The invention claimed is:

1. A writing instrument, comprising:

a body extending along an axial direction and presenting a first axial end and a second axial end opposite from the first axial end along the axial direction;

a single carriage housed in the body and movable in translation along the axial direction relative to the body, the single carriage carrying a first head and a second head opposite from the first head along the axial direction housed in the body and being movable in translation along the axial direction relative to the body and a single blocking device including a single cavity and at least one ball;

the at least one ball is configured to block the single carriage relative to the body when, relative to a direction of gravity, the first axial end is below the second axial end, so that the first head is blocked relative to the body to project axially from the first axial end, while the second head is retracted into the body, and the at least one ball is configured to block the single carriage when, in the direction of gravity, the first axial end is above the second axial end, so that the second head is blocked relative to the body to project axially from the second axial end, while the first head is retracted into the body.

2. The writing instrument of claim 1, wherein the single cavity includes a first chamber and a second chamber distinct from the first chamber, the first chamber being formed between the body and the single carriage, the second chamber being formed between the body and the single carriage, the at least one ball being housed in the first chamber when, in the direction of gravity, the first axial end is below the second axial end, and the at least one ball being housed in the second chamber when, in the direction of gravity, the first axial end is above the second axial end.

3. The writing instrument of claim 2, wherein the first chamber and the second chamber have dimensions that vary as a function of the position of the single carriage relative to the body.

4. The writing instrument of claim 2, wherein the first chamber and the second chamber includes an inlet, an end, and walls that converge from the inlet towards the end.

5. The writing instrument of claim 2, wherein the single cavity includes a passage for the at least one ball, the passage extending between the first chamber and the second chamber, and being arranged between the body and the single carriage.

6. The writing instrument of claim 1, further including at least one striker configured to strike the at least one ball along the direction of gravity, when the first axial end passes from a position above the second axial end to a position below the second axial end, or along the direction of gravity, when the first axial end passes from a position below the second axial end to a position above the second axial end.

7. The writing instrument of claim 6, wherein the at least one striker is two strikers and, in the axial direction, the at least one ball is arranged between the two strikers.

8. The writing instrument of claim 7, wherein the two strikers are coupled together in the axial direction.

9. A writing instrument, comprising:

a body extending along an axial direction and presenting a first axial end and a second axial end opposite from the first axial end along the axial direction;

a first carriage and a second carriage housed in the body and movable in translation along the axial direction relative to the body, the first carriage carrying a first head and the carriage carrying a second head opposite from the first head along the axial direction housed in the body and being movable in translation along the axial direction relative to the body and a single blocking device including a single cavity and at least one ball;

wherein the at least one ball is configured to block the first carriage relative to the body when, relative to a direction of gravity, the first axial end is below the second axial end, so that the first head is blocked relative to the body to project axially from the first axial end, while the second head is retracted into the body, and wherein the at least one ball is configured to block the second carriage when, in the direction of gravity, the first axial end is above the second axial end, so that the second head is blocked relative to the body to project axially from the second axial end, while the first head is retracted into the body.

10. The writing instrument of claim 9, wherein the single cavity includes a first chamber and a second chamber distinct from the first chamber, the first chamber being formed between the body and the first carriage, the second chamber being formed between the body and the second carriage, the at least one ball being housed in the first chamber when, in the direction of gravity, the first axial end is below the second axial end, and the at least one ball being housed in the second chamber when, in the direction of gravity, the first axial end is above the second axial end.

11. The writing instrument of claim 10, wherein the first chamber and the second chamber have dimensions that vary as a function of the position of the positions of the first and second carriages relative to the body.

12. The writing instrument of claim 10, wherein the first chamber and the second chamber includes an inlet, an end, and walls that converge from the inlet towards the end.

13. The writing instrument of claim 10, wherein the single cavity includes a passage for the at least one ball, the passage extending between the first chamber and the second chamber, and being arranged between the body and the first and second carriages.

14. The writing instrument of claim 9, further including at least one striker configured to strike the at least one ball along the direction of gravity, when the first axial end passes from a position above the second axial end to a position below the second axial end, or along the direction of gravity, when the first axial end passes from a position below the second axial end to a position above the second axial end.

15. The writing instrument of claim 14, wherein the at least one striker is two strikers and, in the axial direction, the at least one ball is arranged between the two strikers.

16. The writing instrument of claim 15, wherein the two strikers are coupled together in the axial direction.

* * * * *